US009571934B2

(12) United States Patent
Stabile

(10) Patent No.: US 9,571,934 B2
(45) Date of Patent: Feb. 14, 2017

(54) ACOUSTIC DEVICE WITH PASSIVE RADIATORS

(71) Applicant: Bose Corporation, Framingham, MA (US)

(72) Inventor: Joseph A. Stabile, Worcester, MA (US)

(73) Assignee: Bose Corporation, Framingham, MA (US)

( * ) Notice: Subject to any disclaimer, the term of this patent is extended or adjusted under 35 U.S.C. 154(b) by 7 days.

(21) Appl. No.: 14/226,587

(22) Filed: Mar. 26, 2014

(65) Prior Publication Data

US 2015/0281844 A1 Oct. 1, 2015

(51) Int. Cl.
*H04R 25/00* (2006.01)
*H04R 7/00* (2006.01)
(Continued)

(52) U.S. Cl.
CPC ..... *H04R 7/00* (2013.01); *H04R 1/00* (2013.01); *H04R 1/2834* (2013.01); *H04R 19/02* (2013.01);
(Continued)

(58) Field of Classification Search
CPC ..... H04R 1/283; H04R 2209/026; H04R 7/00
(Continued)

(56) References Cited

U.S. PATENT DOCUMENTS 3,727,719 A 4/1973 Yando
5,850,460 A 12/1998 Tanaka et al.
(Continued)

FOREIGN PATENT DOCUMENTS

EP 2182736 A1 5/2010
WO 2009120467 A1 10/2009
WO 2014036286 A1 3/2014

OTHER PUBLICATIONS

The International Preliminary Report on Patentability issued on Sep. 27, 2016 by the International Bureau on behalf of the International Searching Authority for corresponding PCT Application No. PCT/US2015/022464.*

(Continued)

*Primary Examiner* — Davetta W Goins
*Assistant Examiner* — Phylesha Dabney
(74) *Attorney, Agent, or Firm* — Brian M. Dingman; Dingman IP Law, PC

(57) ABSTRACT

An acoustic device with an enclosure and a first passive radiator structure which includes a first passive radiator diaphragm. The first passive radiator structure has an effective radiating area and a first mass, and is mounted to the enclosure such that its diaphragm can vibrate relative to the enclosure. There is a second passive radiator structure which includes a second passive radiator diaphragm. The second passive radiator structure has substantially the same effective radiating area as the first passive radiator structure, and is mounted to the enclosure such that its diaphragm can vibrate relative to the enclosure. At least one active electroacoustic transducer is mounted to the second passive radiator structure such that it moves when the diaphragm vibrates. The second passive radiator structure and the active transducer together have a second mass that is substantially greater than the mass of the first passive radiator structure. Passive radiators with the same effective radiating area results in force balancing of the device.

18 Claims, 11 Drawing Sheets

(51) Int. Cl.

| | |
|---|---|
| ***H04R 1/00*** | (2006.01) |
| ***H04R 19/02*** | (2006.01) |
| ***H04R 1/28*** | (2006.01) |
| *H04R 1/24* | (2006.01) |

(52) U.S. Cl.
CPC ..... *H04R 1/24* (2013.01); *H04R 2207/00* (2013.01); *H04R 2499/13* (2013.01); *H04R 2499/15* (2013.01)

(58) Field of Classification Search
USPC ..... 381/345, 346, 347, 348, 349, 350, 353, 381/354, 386, 398
See application file for complete search history.

(56) References Cited

U.S. PATENT DOCUMENTS

| | | | |
|---|---|---|---|
| 7,133,533 | B2 | 11/2006 | Chick et al. |
| 7,840,018 | B2 | 11/2010 | Prenta et al. |
| 7,983,436 | B2 | 7/2011 | Nichols et al. |
| 8,031,896 | B2 | 10/2011 | Chick et al. |
| 8,189,841 | B2 | 5/2012 | Litovsky et al. |
| 2010/0027815 | A1 | 2/2010 | Burge |
| 2013/0259258 | A1 | 10/2013 | Ludwig |

OTHER PUBLICATIONS

The International Search Report and The Written Opinion of the International Searching Authority issued on Jul. 6, 2015 in corresponding PCT Application No. PCT/US2015/022464.

* cited by examiner

ACOUSTIC DEVICE WITH PASSIVE RADIATORS

BACKGROUND

This disclosure relates to an acoustic device with passive radiators.

Some acoustic devices include passive radiators. For example, U.S. Pat. No. 5,850,460 discloses an acoustic device with passive radiators of the same effective vibration area and the same effective vibration mass disposed in mutual opposition, and driver units of the same effective vibration area and the same effective vibration mass disposed in mutual opposition, all mounted to an enclosure. The vibration-reaction forces of the opposing passive radiators and opposing driver units on the enclosure are thereby mutually cancelled, and enclosure vibrations are thus reduced. Powerful bass output can be achieved because the diameter of the passive radiators can be increased at will and the use of two passive radiators achieves a large vibration area.

The total mass of the passive radiators needs to be sufficient such that the acoustic device can be tuned to the desired frequency. For bass devices, tuning is usually around 40 Hz. In many cases the mass of one or more of the radiators must be increased by adding weight. Acoustic devices with passive radiators are thus typically relatively heavy, which limits their usefulness in portable products or products in which weight is a concern. Also, with mass-balanced passive acoustic radiators, both radiators are displaced by the same amount. The relatively large excursion of the radiator that carries the active transducer increases the intermodulation distortion which can result in audible unwanted sounds.

SUMMARY

In many applications, including in small portable devices, it is desirable to produce high-quality audio output using as little volume as possible. In these situations, audio output devices can use an enclosure with one or more passive radiators. These acoustic devices often require additional mass to be added to the passive radiators so that the radiators have sufficient mass to accomplish tuning of the enclosure at a desired frequency. In the present disclosure an active transducer is suspended from a passive radiator. This eliminates the need to add mass to that radiator. Also, the present acoustic device includes opposed passive radiators that move in opposition relative to the enclosure. The passive radiator that opposes the radiator that carries the active transducer can have a lighter mass, which allows it to move further during tuning of the enclosure. The effective radiating areas of the opposed passive radiators are substantially the same. Since both radiators are exposed to the same pressure in the enclosure, both radiators have substantially the same forces. If the forces are equal then the device is force balanced at tuning.

All examples and features mentioned below can be combined in any technically possible way.

In one aspect, an acoustic device includes an enclosure, a first passive radiator structure comprising a first passive radiator diaphragm, wherein the first passive radiator structure is mounted to the enclosure such that the first passive radiator diaphragm can vibrate relative to the enclosure, and wherein the first passive radiator structure has an effective radiating area and a first mass, a second passive radiator structure comprising a second passive radiator diaphragm, wherein the second passive radiator structure is mounted to the enclosure such that the second passive radiator diaphragm can vibrate relative to the enclosure, and wherein the second passive radiator structure has substantially the same effective radiating area as the first passive radiator structure, and at least one active electro-acoustic transducer mounted to the second passive radiator diaphragm such that the at least one active electro-acoustic transducer moves when the second passive radiator diaphragm vibrates; the second passive radiator structure and the active electro-acoustic transducer together have a second mass that is different than the first mass. Typically the second mass is greater than, and preferably substantially greater than, the first mass. In one non-limiting example, the second mass is from about two times to about six times greater than the first mass.

Examples may include one of the following features, or any combination thereof. The enclosure may have an interior cavity and the first and second passive radiator diaphragms may each have a rear side that is exposed to the interior cavity of the enclosure. The pressure in the interior cavity of the enclosure may change as the at least one active transducer is operated, and the rear sides of both of the first and second passive radiator diaphragms may be exposed to the same pressures.

Examples may include one of the following features, or any combination thereof. The first passive radiator diaphragm may vibrate along a first vibration axis and the second passive radiator diaphragm may vibrate along a second vibration axis. The first and second vibration axes may be substantially parallel or substantially collinear. The first passive radiator diaphragm and the second passive radiator diaphragm may vibrate in opposition. The second mass may be greater than the first mass. Pressure changes inside the acoustic enclosure may cause both passive radiator diaphragms to move in and out in opposition relative to the enclosure. The first passive radiator diaphragm may move in and out a greater distance than does the second passive radiator diaphragm. As the first and second passive radiator diaphragms move in and out, their effective radiating areas may remain substantially equal. The first passive radiator structure may comprise a first flexible suspension element that couples the first passive radiator diaphragm to the enclosure, and the second passive radiator structure may comprise a second flexible suspension element that couples the second passive radiator diaphragm to the enclosure.

Examples may include one of the following features, or any combination thereof. The pressure in the interior cavity of the enclosure may change as the at least one active transducer is operated, and during such pressure changes substantially equal and opposite forces may be present on each radiator diaphragm. The first passive radiator structure may comprise a first flexible suspension element that couples the first passive radiator diaphragm to the enclosure, and the second passive radiator structure may comprise a second flexible suspension element that couples the second passive radiator diaphragm to the enclosure. The acoustic device may comprise more than one active electro-acoustic transducers that are rigidly mounted to the second passive radiator diaphragm. The second passive radiator diaphragm may vibrate along a vibration axis, and the multiple active electro-acoustic transducers may be spaced from the vibration axis. The active electro-acoustic transducers may be mounted to the second passive radiator diaphragm such that their center of gravity is collinear with the center of gravity axis of the first passive radiator diaphragm. The multiple active electro-acoustic transducers may be substantially identical and may be operated at the same frequency and in phase. The multiple active electro-acoustic transducers may be substantially equally spaced from the vibration axis.

In another aspect, an acoustic device includes a closed enclosure that has an interior cavity, a first passive radiator structure comprising a first passive radiator diaphragm that has a rear side that is exposed to the interior cavity of the enclosure, wherein the first passive radiator structure is mounted to the enclosure such that the first passive radiator diaphragm can vibrate along a first vibration axis relative to the enclosure, and wherein the first passive radiator structure has an effective radiating area and a first mass, a second passive radiator structure comprising a second passive radiator diaphragm that has a rear side that is exposed to the interior cavity of the enclosure, wherein the second passive radiator structure is mounted to the enclosure such that the second passive radiator diaphragm can vibrate in opposition to the first passive radiator diaphragm along a second vibration axis relative to the enclosure that is substantially collinear with the first vibration axis, and wherein the second passive radiator structure has substantially the same effective radiating area as the first passive radiator structure, and at least one active electro-acoustic transducer mounted to the second passive radiator diaphragm such that the at least one active electro-acoustic transducer moves when the second passive radiator diaphragm vibrates. The pressure in the interior cavity of the enclosure changes as the at least one active transducer is operated. The rear sides of both of the first and second passive radiator diaphragms are exposed to the same pressures such that pressure changes inside the acoustic enclosure cause both passive radiator diaphragms to move in and out in opposition relative to the enclosure. The first passive radiator diaphragm moves in and out a greater distance than does the second passive radiator diaphragm. As the first and second passive radiator diaphragms move in and out, their effective radiating areas remain substantially equal. The second passive radiator structure and the active electro-acoustic transducer together have a second mass that is substantially greater than the first mass.

Examples may include one of the following features, or any combination thereof. The first passive radiator structure may comprise a first flexible suspension element that couples the first passive radiator diaphragm to the enclosure, and the second passive radiator structure may comprise a second flexible suspension element that couples the second passive radiator diaphragm to the enclosure. The active transducer may be rigidly mounted to the second passive radiator diaphragm such that it moves as the diaphragm moves. The acoustic device may comprise first and second active electro-acoustic transducers that are rigidly mounted to the second passive radiator diaphragm, wherein the second passive radiator diaphragm vibrates along a vibration axis, and wherein the first and second active electro-acoustic transducers are both spaced from the vibration axis. The first and second active electro-acoustic transducers may be substantially identical, and the first and second active electro-acoustic transducers may both be substantially equally spaced from the vibration axis.

BRIEF DESCRIPTION OF THE DRAWINGS

FIG. 4C taken along line A-A of FIG. 4A.

DETAILED DESCRIPTION

Figure 1A:
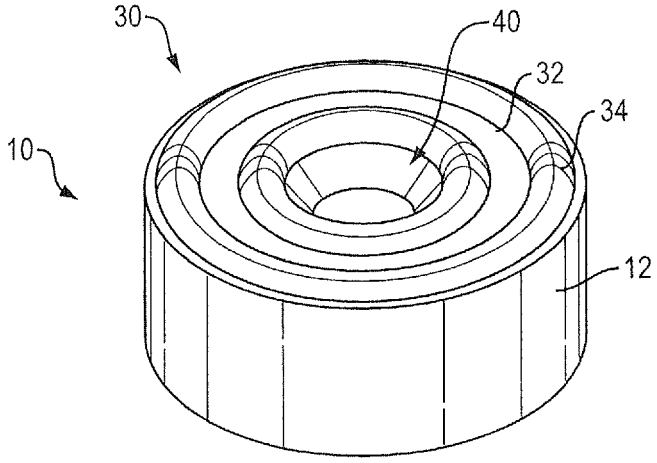
FIGS. 1A-1E are top perspective, bottom perspective, top, bottom and cross-sectional views, respectively, of an acoustic device with passive radiators.
Figure 1B:
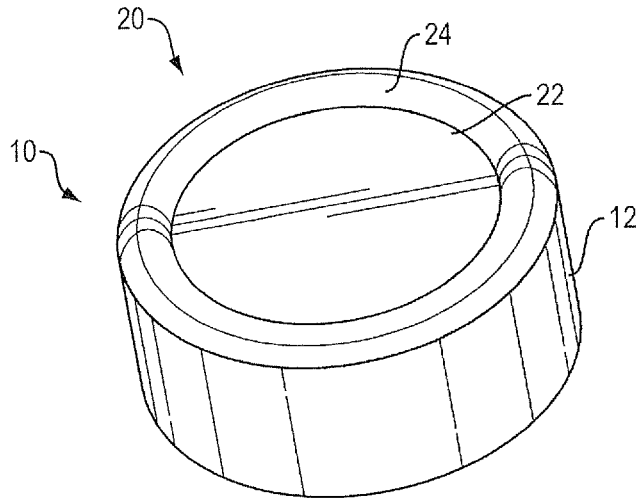
Figure 1C:
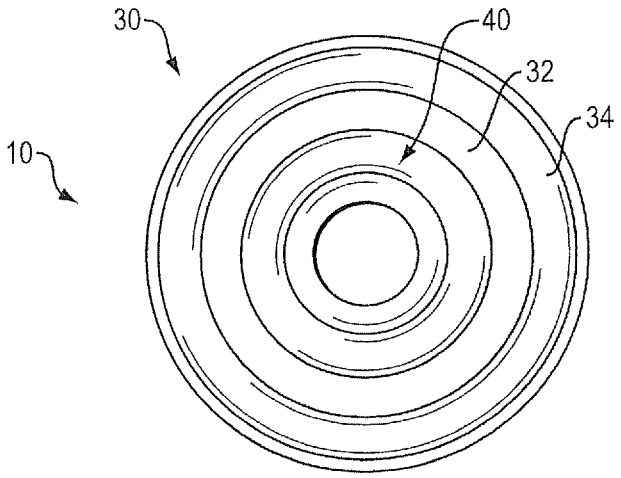
Figure 1D:
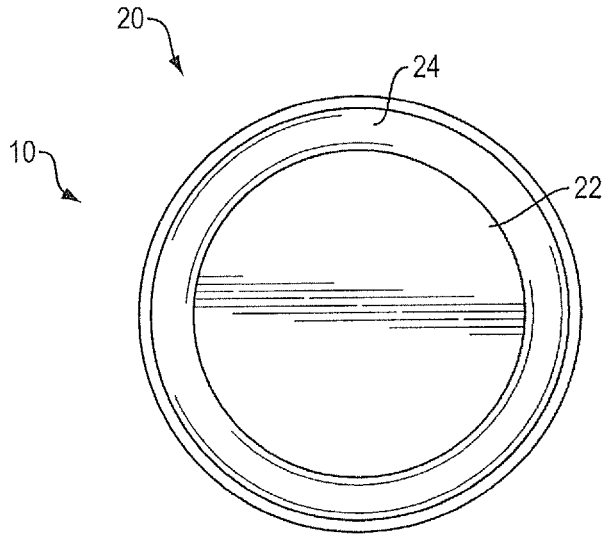
Figure 1E:
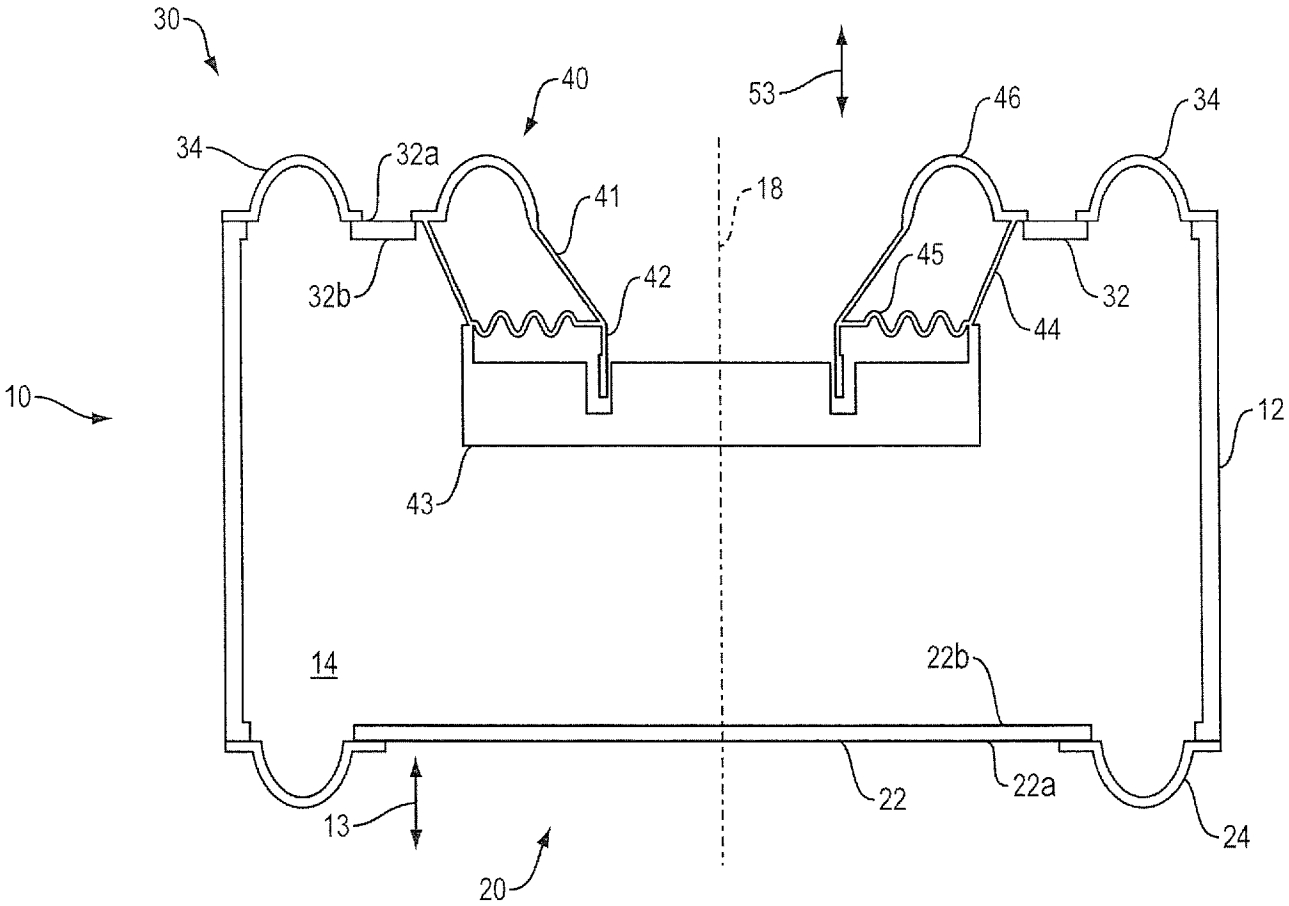

The acoustic device includes opposed passive radiators that move in opposition relative to an enclosure. One of the passive radiators carries one or more active transducers. This eliminates the need to add mass to that radiator. The passive radiator that opposes the radiator that carries the active transducer can have a lighter mass than would otherwise be the case and still allow the enclosure to be tuned to a desired frequency. The lighter mass (which may have but need not have a mass that is about two to about six times less than that of the heavily-loaded passive radiator) allows the passive radiator to move further during tuning of the enclosure. The effective radiating areas of the opposed passive radiators are substantially the same. Since both radiators are exposed to the same pressure in the enclosure, both radiators have substantially the same forces. Since the forces are equal the device is force balanced at tuning.

Acoustic device 10, FIGS. 1A-1E, includes enclosure 12 which defines interior cavity 14. First passive radiator structure 20 closes one open side of enclosure 12. First passive radiator structure 20 includes first passive radiator diaphragm 22 which is coupled to enclosure 12 by suspension element 24. Suspension element 24 is a type of suspension element known in the art and may be a single roll element as shown, or may have another configuration as is known in the art, such as a double roll configuration. Diaphragm 22 has rear surface 22*b* which is exposed to cavity 14, and front surface 22*a* which is open to the outside of the enclosure such that it is able to radiate sound from the enclosure. Diaphragm 22 is constructed and arranged to vibrate relative to enclosure 12 along vibration axis 18 in and out in the direction of arrow 13. Diaphragm 22 may be an essentially flat plate as shown in the drawing or may have a different construction or form as is known in the art of passive radiator diaphragms.

Device 10 also includes second passive radiator structure 30 which closes the opposing side of enclosure 12 from first passive radiator structure 20. Second passive radiator structure 30 includes second passive radiator diaphragm 32 which is coupled to enclosure 12 by suspension element 34, which allows diaphragm 32 to move or vibrate in and out relative to enclosure 12 in the direction of arrow 53 along vibration axis 18. Diaphragm 32 includes rear surface 32*b* which is exposed to interior cavity 14, and exterior surface 32*a* which is exposed to the outside of the enclosure such that it is able to radiate sound from the enclosure.

Active electro-acoustic transducer 40 is mounted to second passive radiator diaphragm 32 such that transducer 40 moves when diaphragm 32 vibrates. Transducer 40 can be any known type of active acoustic transducer. In this non-limiting example transducer 40 includes diaphragm 41, bobbin with voice coil 42, magnet/iron 43, basket 44, suspension 45 and surround 46. Surround 46 does not move at the tuning frequency of enclosure 12. This ensures that the active transducer is part of passive radiator structure 30, while allowing transducer 40 to itself be operated via audio signals (not shown) so as to radiate sound.

As transducer 40 is operated it creates pressure changes in cavity 14 which cause passive radiators 22 and 32 to move in and out and thus radiate sound from the device. In this arrangement the mass of the second passive radiator diaphragm that is required in order to tune the enclosure is accomplished fully or at least in part with the active transducer. Also, some prior art acoustic devices are designed such that the masses of the opposed passive radiators are equal; this would require that the first passive diaphragm would need to have mass added to it, to match the mass of the diaphragm that carries the transducer. A result is that these prior art acoustic devices are heavy, which limits their applicability to situations in which weight is not a concern. Also, the present arrangement results in a less massive acoustic device than would be the case if the active transducer was mounted elsewhere on the enclosure. The weight savings can be a significant advantage in situations such as portable devices or even motor vehicles where a goal is to reduce weight without sacrificing functionality. Also, the acoustic device can be smaller since there is less volume needed for the active transducer. Since the acoustic device is smaller and lighter than many existing designs, it has wider applicability to more a more diverse set of products. Non-limiting examples of products that could use acoustic device 10 includes personal hand-held audio devices, portable audio devices, motor vehicles, and products that are designed to hang on a wall (such as televisions and monitors).

First passive radiator structure 20 and second passive radiator structure 30 have substantially the same effective radiating area. Ideally their effective radiating areas are the same, so that there is no force imbalance. The effective radiating area of a radiator structure as it vibrates can be determined by mounting the structure to a known closed volume, moving the structure in and out, and detecting pressure changes in the closed volume. The effective area can then be determined relative to the stroke. The passive radiator structures will have substantially the same effective radiating areas when the net force imbalance due to an area mismatch between the radiators when at their maximum extensions is less than the design acceptable force imbalance for the particular acoustic device. One non-limiting example of an acceptable force imbalance is for automobile door-mounted devices, where a force imbalance of more than about 5 newtons will cause unwanted sounds. Since the rear sides of both radiating structures are exposed to the same cavity 14, the two radiating structures are exposed to the same pressure within closed cavity 14. And, since the effective radiating areas are substantially the same, the forces developed on both of the passive radiator structures are substantially the same. The enclosure is thus force balanced and so vibrates much less than acoustic devices with passive radiators of unequal area. Force balancing is dependent on area and is independent of mass. The acoustic device herein is thus well suited for applications where vibration would be an impediment, such as wall hanging devices, motor vehicles, portable devices in which vibration in the user's hand is unwanted, and applications where the device would be sitting or mounted on a surface where vibrations could cause abnormal unwanted sounds that might interfere with the desired audio output.

The radiator without the active transducer moves more than the heavier radiator, and thus contributes more to the acoustic output. The radiator that moves more has no electrical connection to it and so is more reliable since there are no wires to break. Further, it has a lower mass and a lower moment of inertia so the rocking frequency is higher than any frequency at which the passive radiator would vibrate, and thus it is not subject to rocking motions. Also, since the radiator with the larger motion does not have an active transducer coupled to it, there is no intermodulation distortion possible from this radiator. The higher mass radiator that has the active transducer would have noticeable intermodulation distortion if it had a greater excursion than it does. But since it is heavily mass loaded it will move substantially less than the lightly loaded radiator. Thus any intermodulation distortion from the acoustic device will be greatly reduced or eliminated.

Figure 2A:
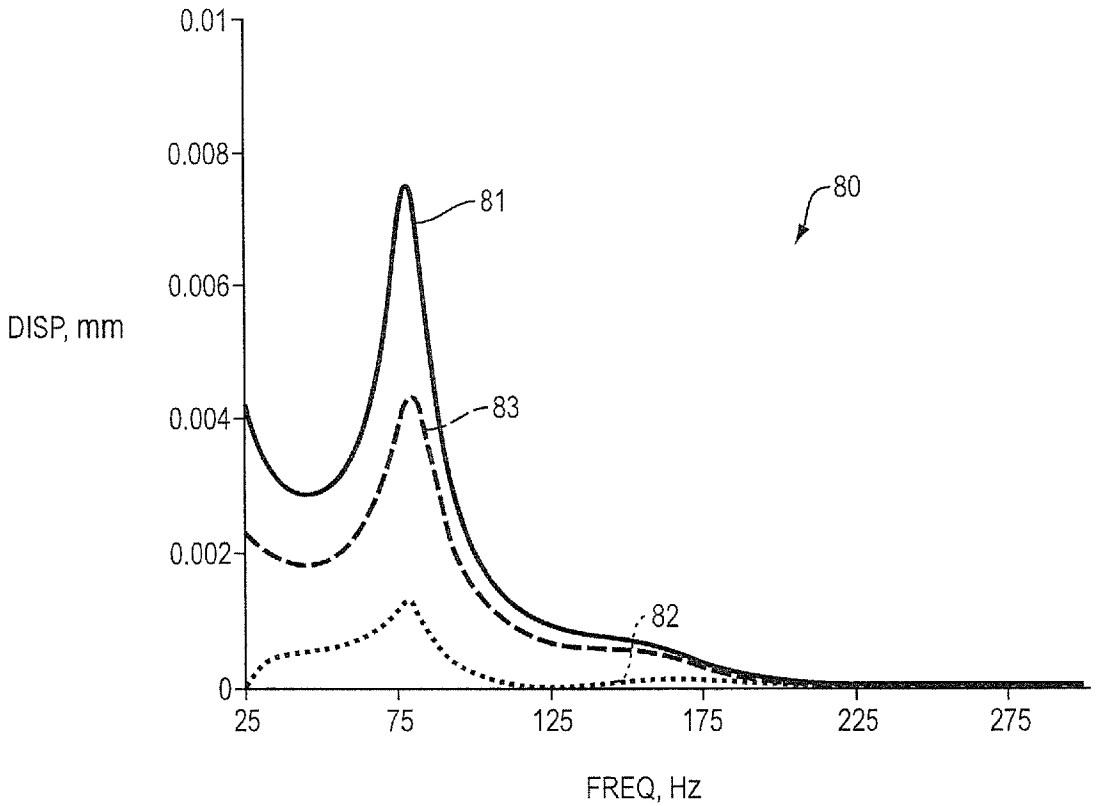
FIG. 2A is a plot of displacement versus frequency for passive radiators.

FIG. 2A is a plot 80 of displacement versus frequency for three passive radiators. Plot line 81 is for lightly-loaded passive radiator 22 of acoustic device 10, FIG. 1, while plot line 82 is for heavily-loaded passive radiator 32 of acoustic device 10, FIG. 1 (which was about six times more massive than passive radiator 22). These illustrate that the lightly loaded passive radiator moves about six times more than the heavily loaded radiator. Plot line 83 is for comparison and illustrates motion of mass balanced passive radiators in a prior art passive sealed bass box with the acoustic device mounted separately from the passive radiators. FIG. 2A illustrates that in the inventive device the excursion of the lighter passive radiator is substantially greater than that of the heavier passive radiator, or of the prior art passive radiators. This figure also illustrates that the two passive radiators with substantially different masses (different by about six times in this non-limiting example) have the same resonant frequency of around 75 Hz. Advantages of the subject passive radiators are described elsewhere herein.

Figure 2B:
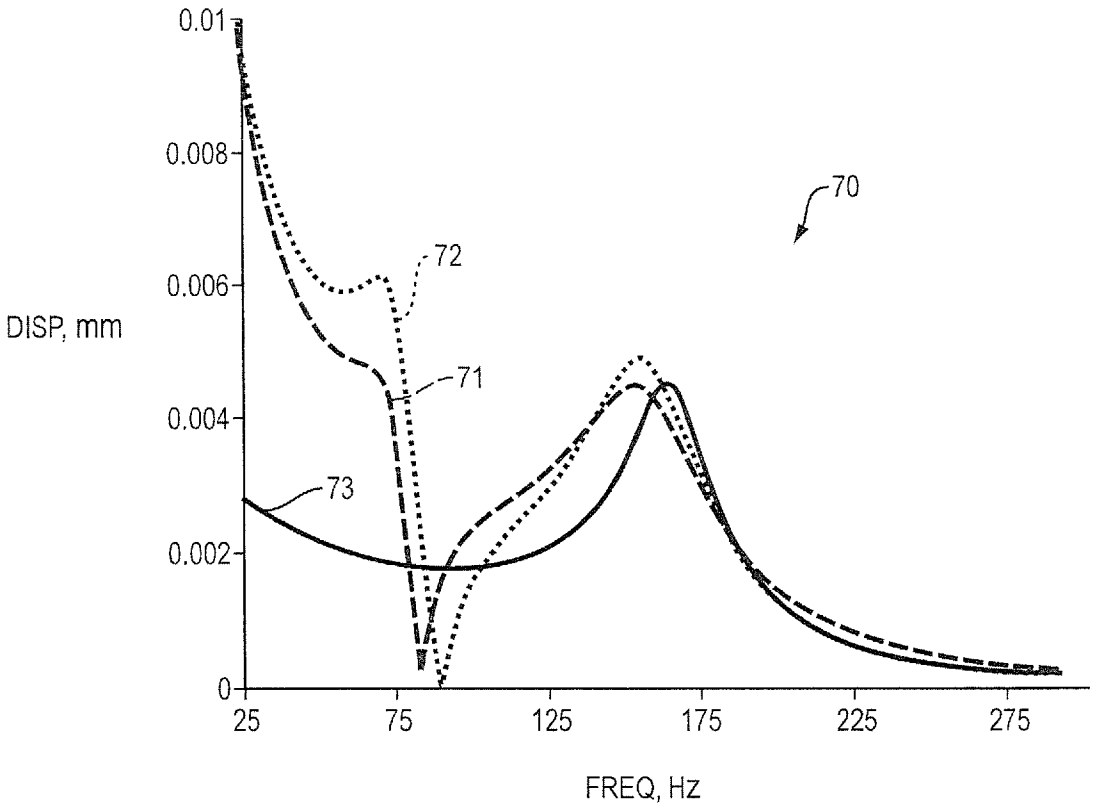
FIG. 2B is a plot of displacement versus frequency for the cones of active transducers.
Figure 3A:
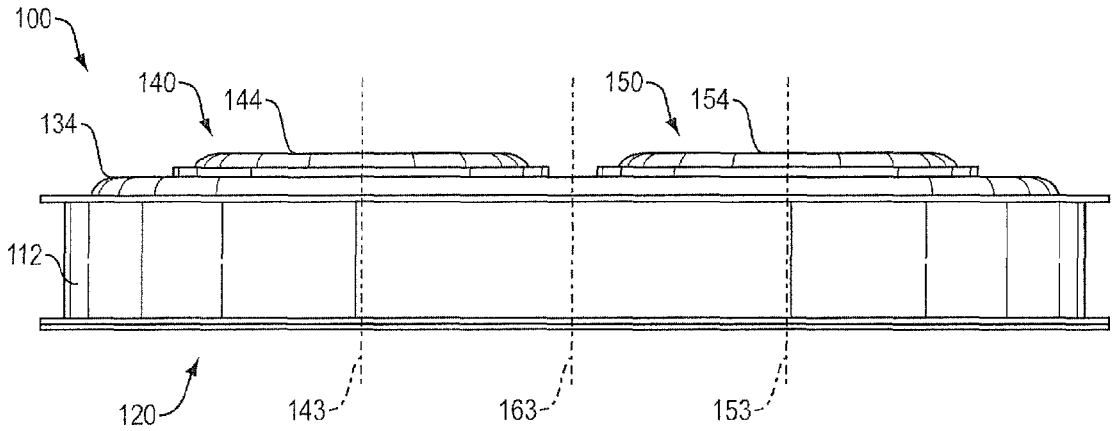
FIGS. 3A-3D are side, top, end and cross-sectional views, respectively, of an acoustic device with passive radiators.
Figure 3B:
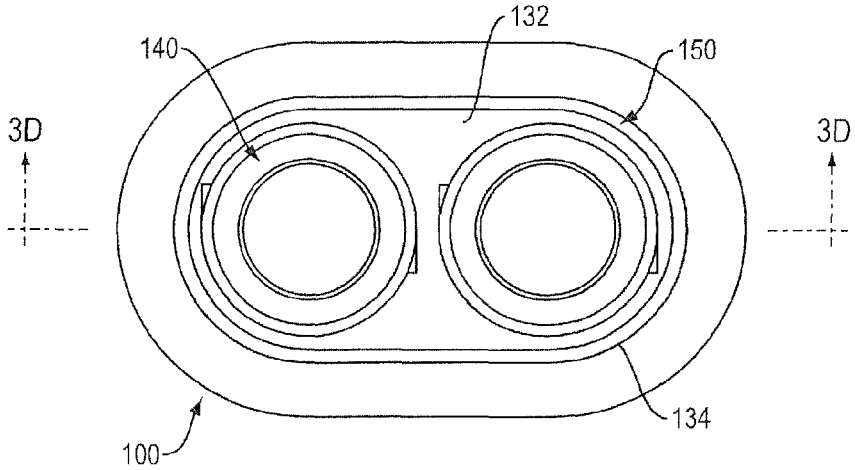
Figure 3C:
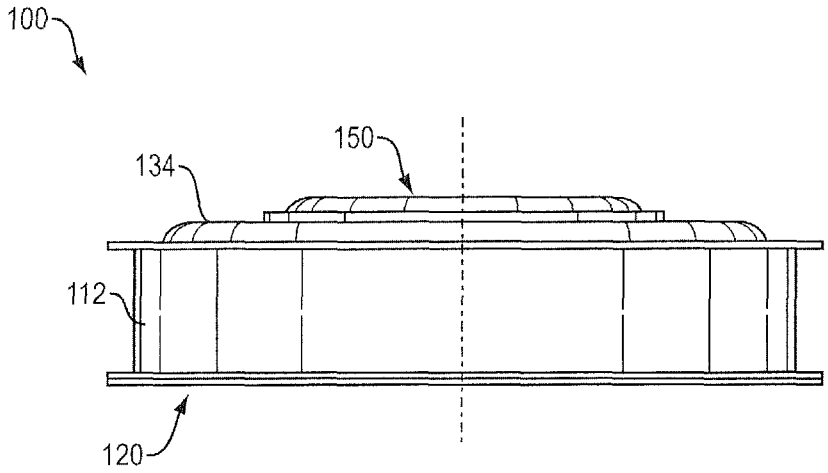
Figure 3D:
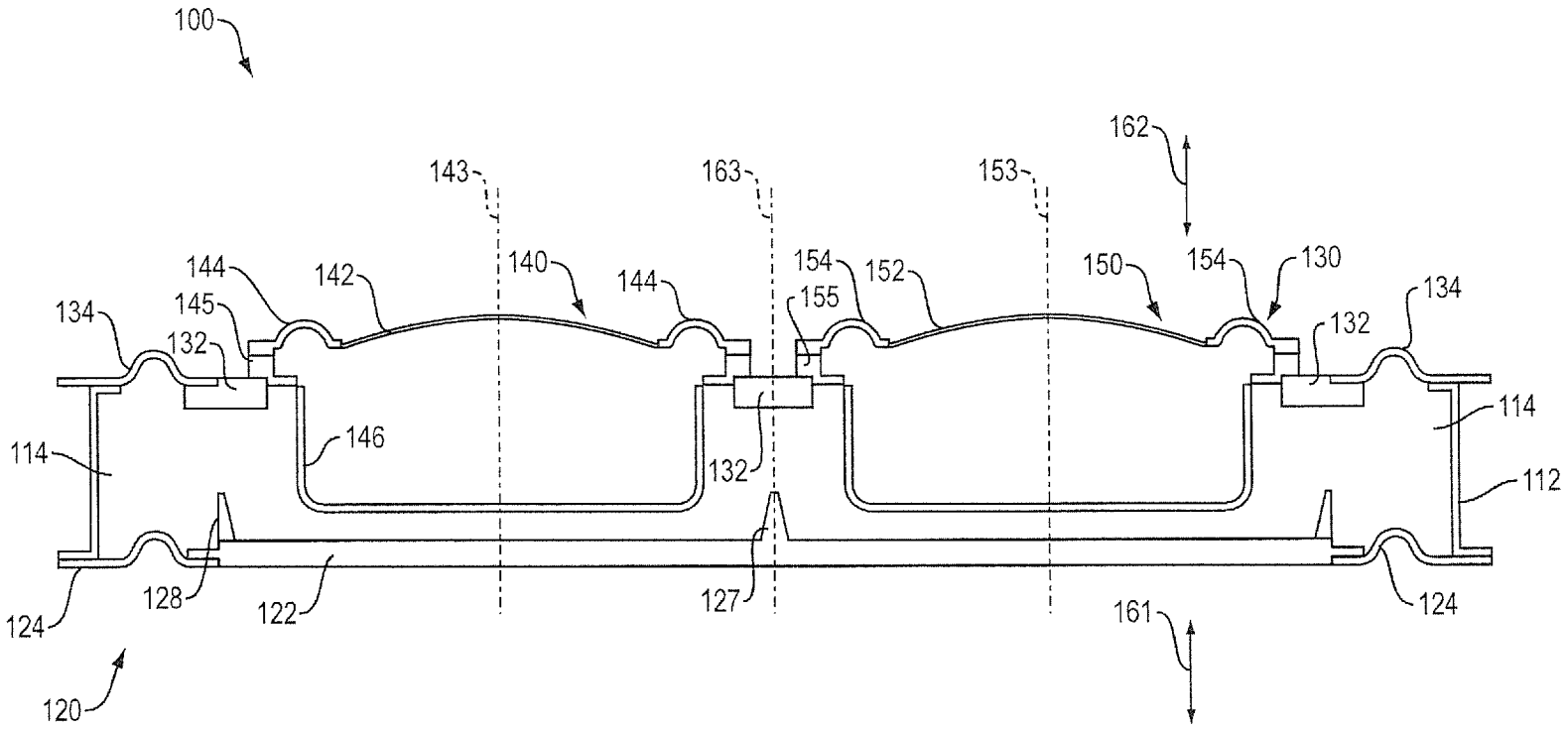

FIG. 2B is a plot 70 of displacement (mm) versus frequency (Hz) for the cones of three active transducers. Plot line 71 is for cone 41 of transducer 40, FIG. 1. This illustrates that at the enclosure tuning frequency of about 80 Hz there is essentially zero excursion of the cone relative to the transducer motor and that the cone is at resonance at around 170 Hz. Plot line 72 illustrates active transducer cone displacement for a prior art sealed enclosure acoustic device with passive radiators and a separately-mounted active transducer that is mounted directly to the device enclosure. Plot lines 71 and 72 establish that the active transducer of the inventive acoustic device (which is mounted to a passive radiator) acts essentially the same as an active transducer that is mounted directly to the enclosure. Plot line 73 is for the cone of an active transducer in a prior art classic sealed bass box with no passive radiators. FIG. 2B demonstrates that passive radiators allow for more bass output at lower frequencies than classic sealed boxes with no passive radiators.

The passive radiator structure that carries an active transducer can carry one or more active transducers as desired to achieve a particular acoustic result. One non-limiting example of the use of multiple active transducers is shown in FIGS. 3A-3D in which acoustic device 100 includes generally oval enclosure 112 with two opposed oval open faces that are closed by passive radiator structures. First passive radiator structure 120 includes first passive radiator diaphragm 122. Diaphragm 122 in this non-limiting example is a generally flat plate, and has interior stiffening ribs 127 and 128 that help it to vibrate in and out with little or no bending. First passive radiator diaphragm 122 is coupled to enclosure 112 by suspension element 124 such that diaphragm 122 is constructed and arranged to vibrate in and out relative to enclosure 112 along common passive radiator vibration axis 163 in the direction of arrow 161.

Second passive radiator structure 130 is coupled to enclosure 112 by suspension element 134. Passive radiator structure 130 includes second passive radiator diaphragm 132 which is constructed and arranged to vibrate in and out along axis 163 in the direction of arrow 162. First active electro-acoustic transducer 140 and second active electro-acoustic transducer 150 are mounted to second passive radiator diaphragm 132 such that they move when the second passive radiator diaphragm 132 vibrates. This mounting of the transducers can be accomplished in a desired fashion. In this non-limiting example active transducer 140 is mounted to diaphragm 132 by stiff mounting frame 145. Similarly, active transducer 150 is mounted to diaphragm 132 by stiff mounting frame 155. Transducer 140 comprises suspension element 144 that allows diaphragm 142 to move in and out along vibration axis 143. Similarly, transducer 150 comprises suspension element 154 that allows diaphragm 152 to move in and out along vibration axis 153. Transducers 140 and 150 are mounted such that their center of mass is collinear with the center of mass of passive radiator diaphragm 122, i.e., along axis 163. Axes 143 and 153 are substantially parallel, and are both substantially parallel to axis 163. Transducers 140 and 150 are preferably operated at the same frequencies and in phase. In cases not shown in the drawings, the subject acoustic device can include more than two active transducers arranged such that their center of mass is coincident with the center of gravity of the lighter passive radiator.

The first and second passive radiator structures have substantially the same effective radiating area. Passive radiator structure 130 has substantially greater mass than passive radiator structure 120. Without limiting the generality of the foregoing, the mass ratio of the two passive radiator structures of the subject acoustic devices may be in the range of from about two to about six to one. Since the radiator structures are exposed to the same pressure variations as transducers 140 and 150 are operated, substantially the same forces are developed on the two radiator structures. The heavier structure 130 and its passive radiator diaphragm 132 will thus move less than the lighter structure 120. Since the overall excursion of diaphragm 132 is relatively small, there is less intermodulation distortion between the active radiators 140 and 150 and the passive radiator 132.

FIGS. 1-3 depict multiple non-limiting examples of an acoustic device with passive radiators. Nevertheless, it will be understood that additional modifications may be made without departing from the scope of the inventive concepts described herein, and, accordingly, other embodiments are within the scope of the following claims. For example, although the two passive radiator structures which move in opposition have substantially the same effective radiating area, they do not need to be the same shape. As one non-limiting example, the first passive radiator diaphragm could be annular and define a central opening that was larger than the second passive radiator structure that carried the active transducer, so that the two diaphragms could be co-planar or closer to co-planar than depicted in FIGS. 1-3. One result of such an arrangement would be that the device could be extremely thin.

Figure 4A:
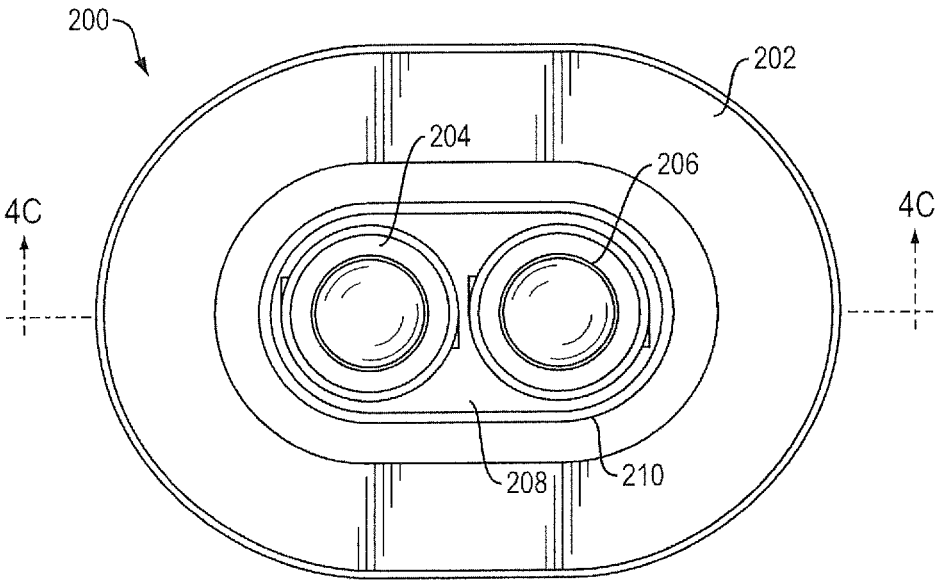
FIGS. 4A-4C are top, bottom, and cross-sectional views, respectively, of an acoustic device with passive radiators.
Figure 4B:
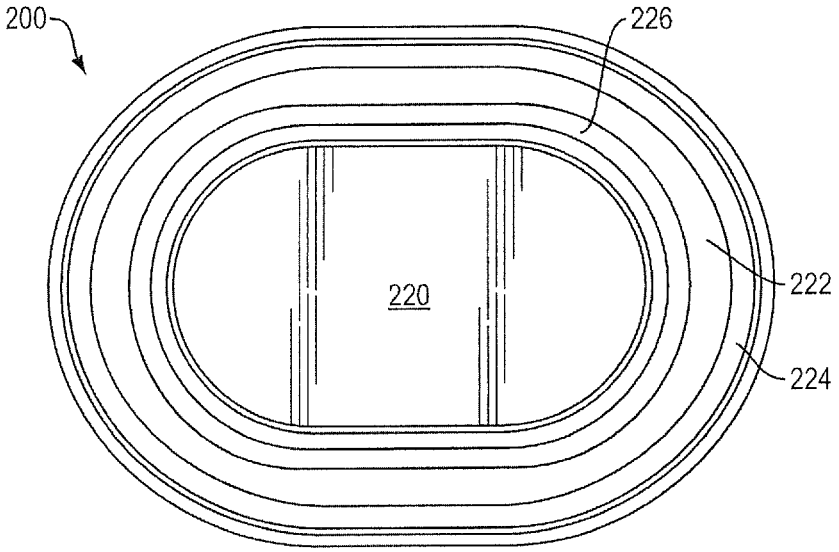
Figure 4C:
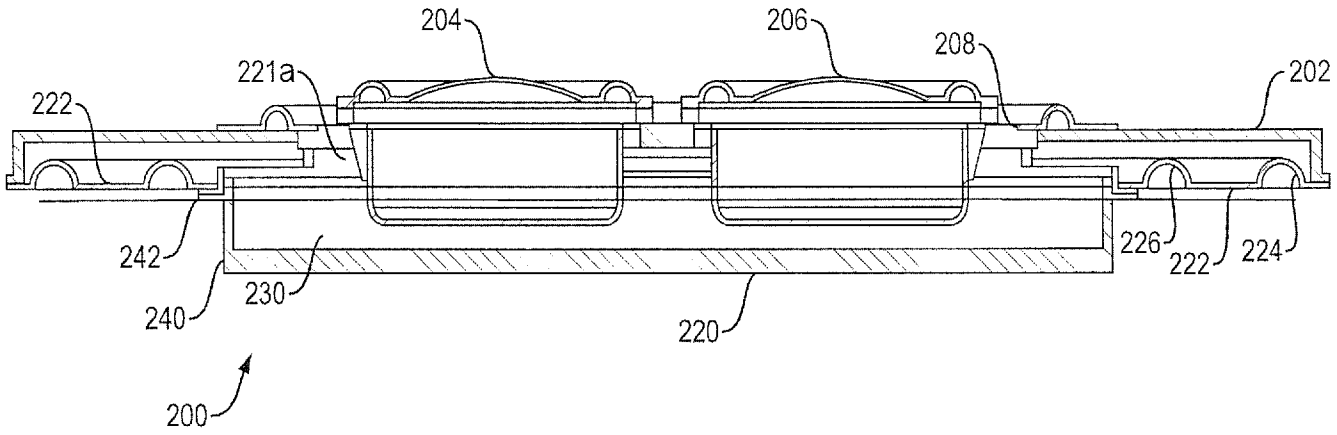
Figure 4D:
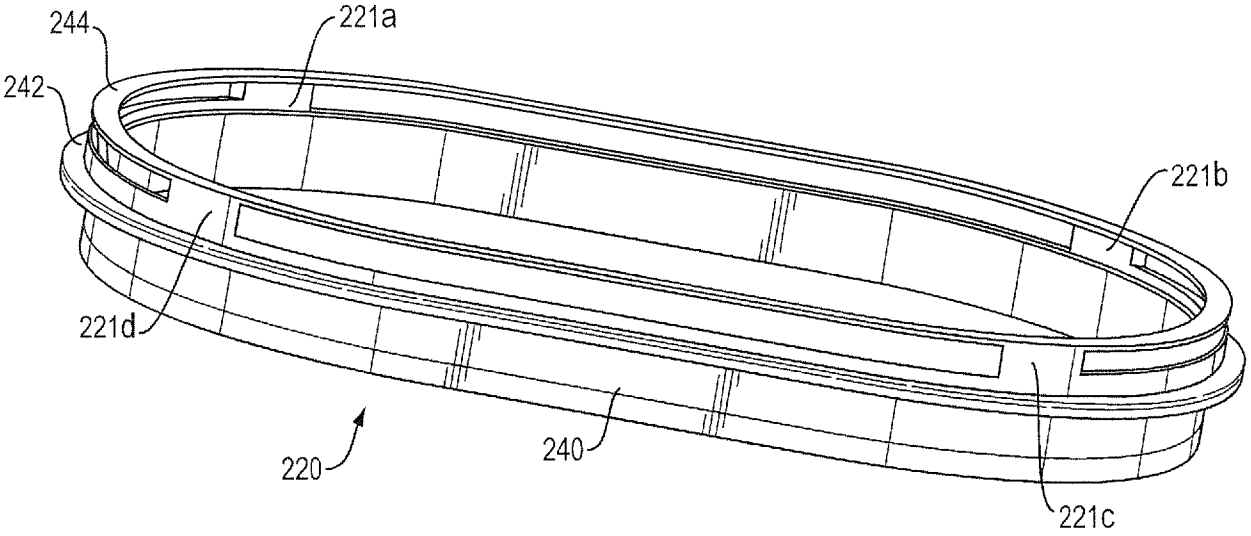
FIG. 4D is a top perspective view of the lower housing member of the acoustic device with passive radiators shown in FIGS. 4A-4C.

A non-limiting example of an ultra thin acoustic device with passive radiators is shown in FIGS. 4A-4D. The design is similar to the design shown in FIG. 3, but the lightly-loaded passive radiator is configured differently such that the device is substantially thinner. Acoustic device 200 includes front passive radiator 208 that carries active transducers 204 and 206. Passive radiator 208 is mounted to top enclosure or housing portion 202 by suspension element 210. Rear lightly-loaded passive radiator 222 has a generally annular shape and is mounted on one side to top housing portion 202 by suspension element 224, and on the other side to lower housing portion 220 by suspension element 226. Both passive radiators are exposed to the single interior cavity 230, which is open to and extends below housing portion 202. Transducers 204 and 206 are spaced from lower housing portion 220 sufficiently (illustrated by space 231) so as to allow passive radiator 208 to reach its maximum excursion. FIG. 4D shows lower housing portion 220 in more detail. Sidewall 240 includes pillars 221*a*-221*d* that support top shelf 244, which is mechanically coupled to the bottom of top housing portion 202. Central horizontal shelf 242 provides a mounting location for suspension element 226. A result of the ultra thin design illustrated in FIG. 4 is that the two opposed passive radiators are almost co-planar and the housing has a thickness just greater than the depth of the active transducers. The acoustic device can thus fit into small spaces and is better adapted to be used in a wall-hanging device, such as a monitor or a loudspeaker.

What is claimed is:

1. An acoustic device, comprising:

an enclosure;

a first passive radiator structure comprising a first vibrating portion that comprises a first passive radiator diaphragm, wherein the first passive radiator structure is mounted to the enclosure such that the first vibrating portion can vibrate relative to the enclosure, and wherein the first vibrating portion has a first effective radiating area and a first mass;

a second passive radiator structure comprising a second vibrating portion comprising a second passive radiator diaphragm, wherein the second passive radiator structure is mounted to the enclosure such that the second vibrating portion can vibrate relative to the enclosure, and wherein the second vibrating portion has substantially the same effective radiating area as the first effective radiating area;

wherein the second vibrating portion further comprises at least one active electro-acoustic transducer mounted to the second passive radiator diaphragm such that the at least one active electro-acoustic transducer moves when the second passive radiator diaphragm vibrates;

wherein the second vibrating portion has a second mass that is greater than the first mass, and;

wherein pressure changes within the enclosure generated by the active electroacoustic transducer apply first and second forces to the first and second vibrating portions respectively wherein the first and second forces are balanced.

2. The acoustic device of claim 1 wherein the enclosure is a closed enclosure.

3. The acoustic device of claim 2 wherein:

the enclosure has an interior cavity; and the first and second passive radiator diaphragms each have a rear side that is exposed to the interior cavity of the enclosure.

4. The acoustic device of claim 3 wherein the pressure in the interior cavity of the enclosure changes as the at least one active transducer is operated, and wherein the rear sides of both of the first and second passive radiator diaphragms are exposed to the same pressures.

5. The acoustic device of claim 1 wherein the first passive radiator diaphragm vibrates along a first vibration axis and the second passive radiator diaphragm vibrates along a second vibration axis, and wherein the first and second vibration axes are substantially parallel or substantially collinear.

6. The acoustic device of claim 5 wherein the first passive radiator diaphragm and the second passive radiator diaphragm vibrate in opposition.

7. The acoustic device of claim 6 wherein:

pressure changes inside the acoustic enclosure cause both passive radiator diaphragms to move in and out in opposition relative to the enclosure;

the first passive radiator diaphragm moves in and out a greater distance than does the second passive radiator diaphragm; and as the first and second passive radiator diaphragms move in and out, their effective radiating areas remain substantially equal.

8. The acoustic device of claim 7 wherein the first passive radiator structure comprises a first flexible suspension element that couples the first passive radiator diaphragm to the enclosure, and the second passive radiator structure comprises a second flexible suspension element that couples the second passive radiator diaphragm to the enclosure.

9. The acoustic device of claim 1 wherein the first passive radiator structure comprises a first flexible suspension element that couples the first passive radiator diaphragm to the enclosure, and the second passive radiator structure comprises a second flexible suspension element that couples the second passive radiator diaphragm to the enclosure.

10. The acoustic device of claim 1 comprising first and second active electro-acoustic transducers that are rigidly mounted to the second passive radiator diaphragm.

11. The acoustic device of claim 10 wherein the second passive radiator diaphragm vibrates along a vibration axis, and wherein the first and second active electro-acoustic transducers are both spaced from the vibration axis.

12. The acoustic device of claim 11 wherein the first and second active electro-acoustic transducers are substantially identical.

13. The acoustic device of claim 12 wherein a center of gravity of the first and second active electro-acoustic transducers is substantially collinear with the vibration axis.

14. An acoustic device, comprising:

an enclosure comprising an interior cavity;

a first passive radiator structure comprising a first vibrating portion that comprises a first passive radiator diaphragm comprising a rear side that is exposed to the interior cavity of the enclosure, wherein the first passive radiator structure is mounted to the enclosure such that the first vibrating portion can vibrate along a first vibration axis relative to the enclosure, and wherein the first vibrating portion has a first effective radiating area and a first mass;

a second passive radiator structure comprising a second vibrating portion comprising a second passive radiator diaphragm comprising a rear side that is exposed to the interior cavity of the enclosure, wherein the second passive radiator structure is mounted to the enclosure such that the second vibrating portion can vibrate in opposition to the first vibrating portion along a second vibration axis relative to the enclosure that is substantially collinear with the first vibration axis, and wherein the second vibrating portion has substantially the same effective radiating area as the first vibrating portion;

at least one active electro-acoustic transducer mounted to the second passive radiator diaphragm such that the at least one active electro-acoustic transducer moves when the second passive radiator diaphragm vibrates;

wherein the second vibrating portion has a second mass that is at least two times greater than the first mass, and;

wherein pressure changes within the enclosure generated by the active electroacoustic transducer apply first and second forces to the first and second vibrating portions respectively wherein the first and second forces are balanced.

15. The acoustic device of claim 14 wherein the first passive radiator structure comprises a first flexible suspension element that couples the first passive radiator diaphragm to the enclosure, and the second passive radiator structure comprises a second flexible suspension element that couples the second passive radiator diaphragm to the enclosure.

16. The acoustic device of claim 15 wherein the pressure in the interior cavity of the enclosure changes as the at least one active transducer is operated, and wherein the rear sides of both of the first and second passive radiator diaphragms are exposed to the same pressures such that pressure changes inside the acoustic enclosure cause both passive radiator diaphragms to move in and out in opposition relative to the enclosure, where the first passive radiator diaphragm moves in and out a greater distance than does the second passive radiator diaphragm and as the first and second passive radiator diaphragms move in and out, the effective radiating areas of the first and second vibrating portions remain substantially equal.

17. The acoustic device of claim 16 comprising first and second active electro-acoustic transducers that are mounted to the second passive radiator diaphragm by flexible suspension elements, wherein the second passive radiator diaphragm vibrates along a vibration axis, and wherein the first and second active electro-acoustic transducers are both spaced from the vibration axis.

18. The acoustic device of claim 17 wherein the first and second active electro-acoustic transducers are substantially identical, and wherein a center of gravity of the first and second active electro-acoustic transducers is substantially collinear with the vibration axis.

* * * * *